US009976454B2

(12) United States Patent
Schulz

(10) Patent No.: US 9,976,454 B2
(45) Date of Patent: May 22, 2018

(54) ADJUSTING ELEMENT FOR THE AXIAL DISPLACEMENT OF A CAMSHAFT SUPPORTED DISPLACEABLE ALONG A CAMSHAFT AXIS

(71) Applicant: KENDRION (Villingen) GmbH, Villingen-Schwenningen (DE)

(72) Inventor: Florian Schulz, Brigachtal (DE)

(73) Assignee: KENDRION (Villingen) GmbH, Villingen-Schwenningen (DE)

( * ) Notice: Subject to any disclaimer, the term of this patent is extended or adjusted under 35 U.S.C. 154(b) by 63 days.

(21) Appl. No.: 14/977,816

(22) Filed: Dec. 22, 2015

(65) Prior Publication Data

US 2016/0265397 A1 Sep. 15, 2016

(30) Foreign Application Priority Data

Mar. 13, 2015 (DE) ..... 10 2015 103 761

(51) Int. Cl.
*F01L 1/34* (2006.01)
*F01L 13/00* (2006.01)
(Continued)

(52) U.S. Cl.
CPC ..... *F01L 13/0015* (2013.01); *F01L 1/053* (2013.01); *F01L 13/0036* (2013.01); *F01L 1/08* (2013.01);
(Continued)

(58) Field of Classification Search
CPC ..... F01L 13/0015; F01L 2013/0078; F01L 13/0036; F01L 1/053; F01L 2013/101; F01L 1/08; F01L 2013/0052
(Continued)

(56) References Cited

U.S. PATENT DOCUMENTS 8,418,667 B2 * 4/2013 Nendel ..... F01L 13/0036 123/90.16

FOREIGN PATENT DOCUMENTS

DE 100 54 623 A1 3/2000
DE 10 2004 033 798 A1 7/2004
(Continued)

OTHER PUBLICATIONS

EPO search report for related application 15 198234.5, dated Aug. 3, 2016.

(Continued)

*Primary Examiner* — Zelalem Eshete
(74) *Attorney, Agent, or Firm* — William Gray Mitchell

(57) ABSTRACT

The present invention relates to an adjusting element for the axial displacement of a camshaft, supported displaceably along an axis of the camshaft, or a camshaft section arranged displaceably on a shaft along the axis of the camshaft, with the adjusting element being mobile between a first position and a second position, the adjusting element showing a guide section by which one or more projections of a camshaft, supported in an axially displaceable fashion, or a camshaft section, supported in an axially displaceable fashion, can cooperate in the first position such that the camshaft or the camshaft section can be axially displaced by a rotation about the axis of the camshaft, and the projection does not cooperate with the guide section in the second position. Furthermore, the invention relates to a device which comprises an axially displaceable camshaft, which shows one or more projections and such an adjusting element.

20 Claims, 3 Drawing Sheets

(51) Int. Cl.
*F01L 1/053* (2006.01)
*F01L 1/08* (2006.01)

(52) U.S. Cl.
CPC ..... *F01L 2013/0052* (2013.01); *F01L 2013/0078* (2013.01); *F01L 2013/101* (2013.01)

(58) Field of Classification Search
USPC ..... 123/90.16
See application file for complete search history.

(56) References Cited

FOREIGN PATENT DOCUMENTS

| | | | |
|---|---|---|---|
| DE | 10 2004 055 852 | A1 | 9/2004 |
| DE | 10 2007 010 152 | A1 | 3/2007 |
| DE | 10 2007 010 151 | A1 | 4/2008 |
| DE | 10 2007 010 152 | A2 | 4/2008 |
| DE | 10 2009 053 116 | A1 | 11/2009 |
| DE | 10 2011 054 218 | A1 | 10/2011 |
| DE | 10 2011 054 218 | A1 | 4/2013 |

OTHER PUBLICATIONS

German office action for related application 10 2015 103 761.0, dated Mar. 7, 2016.

* cited by examiner

ADJUSTING ELEMENT FOR THE AXIAL DISPLACEMENT OF A CAMSHAFT SUPPORTED DISPLACEABLE ALONG A CAMSHAFT AXIS

CROSS REFERENCE TO RELATED APPLICATIONS

This patent application claims priority to German Patent Application 10 2015 103 761.0, filed on Mar. 13, 2015.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The present invention relates to an adjusting element for the axial displacement of a camshaft, supported in an axially displaceable fashion, or a camshaft section supported on a shaft and displaceable along the axis of the camshaft. Furthermore, the invention relates to a device for the axial displacement of a camshaft or a camshaft section, comprising an axially displaceable camshaft or an axially displaceable camshaft section, showing one or more projections, and an appropriate adjusting element.

Background of the Invention

Camshafts show a number of cams, which represent eccentric sections on the camshaft. The cams may either be arranged fixed on the camshaft or the camshaft section, which may be applied on the cylindrical shaft in a torque-proof but axially displaceable fashion. Using the cams, adjacently arranged, axially displaceable components may be displaced in regular intervals by rotating the camshaft. A striking application of the camshaft is here given in the opening and closing of valves in an internal combustion engine. In modern internal combustion engines it is possible to change the motor characteristics, for example from a comfort-emphasized to a sporty characteristic, which is implemented, among other things by the change of the valve stroke, determined by the shape of the cams. Additionally, the different engine speeds require variable valve strokes in order to optimize the torque and the fuel consumption. Other internal combustion engines show a cylinder shut-off, in which some of the cylinders can be shut off in order to save fuel. In this case, the valves of the shut-off cylinders no longer need to be opened at all. Here, too, it is not only advantageous to shut off only individual cylinders, but also to allow variable valve strokes for the above-stated reasons. Such internal combustion engines require camshafts, which show cams with different sizes and shapes. A camshaft section of such a camshaft is shown in FIG. 1, with its jacket area being divided into three sections. In a first section a first cam is provided, which opens a valve of an internal combustion engine with a first stroke curve. In a second section a second cam is provided which is smaller in reference to the first cam and which shows a different geometry and thus during the rotation of the camshaft the valve opens with a second stroke curve in reference to the first stroke curve, less widely and for a shorter period of time with a different speed profile. No cam at all is provided in a third section so that a valve cooperating with the first section is not operated at all when the camshaft rotates, which for example is the case when the cylinder is shut off. The camshaft section shown in FIG. 1 respectively illustrates two of these sections, so that for a four-cylinder internal combustion engine two of these camshaft sections must be provided.

In order to allow opening and closing the valve with the different stroke curves, however, the camshaft or the camshaft section must be axially displaced in order to allow the respectively applicable cams to cooperate with the valve. In the solutions of prior art, which are described for example in DE 10 2007 307 232 A1, EP 2 158 596 B1, and DE 10 2013 102 241 A1, the camshafts show different grooves, engaged by an actuator with a different number of tappets. Here the grooves show a guidance section and form, together with the engaging tappets, a gate guide for the axial displacement of the camshaft, which for this purpose must be rotated to a certain extent.

Due to the fact that the tappets of the actuator must be moved to and fro in a coordinated fashion, the actuators are designed in a relatively complicated manner. Additionally, the grooves must be cut into the camshaft, which involves considerable production expenses particularly due to the fact that a separate cam is provided for each tappet, which additionally may show a separate cross-section. Furthermore, the camshaft is weakened in the area in which the grooves are arranged, which increases the probability of a break in this area. This possibility is further increased by stress peaks, which are caused by the cams.

The object of the present invention is therefore to create an arrangement by which a camshaft can be axially displaced in a simply designed fashion.

This object is attained in an adjusting element as described herein.

BRIEF SUMMARY OF THE INVENTION

In a preferred embodiment, an adjusting element for the axial displacement of a camshaft supported displaceably along an axis of the camshaft or a camshaft section supported displaceably on a shaft along an axis of the camshaft, with the adjusting element being mobile between a first position and a second position, the adjusting element comprising a guide section, cooperating with one or more projections of a camshaft, supported in an axially displaceable fashion, or a camshaft section supported in an axially displaceable fashion, in a first position such that the camshaft or the camshaft section is axially displaceable by a rotation about the axis of the camshaft, and the projection does not cooperate with the guide section in a second position.

In another preferred embodiment, the adjusting element as described herein, wherein the guide section shows one or more guide areas of the adjusting element, which are inclined at least sectionally in reference to a central level of the adjusting element.

In another preferred embodiment, the adjusting element as described herein, wherein the guide section comprises a first guide area and a second guide area, with the first guide area and the second guide area being oppositely inclined in reference to the central level.

In another preferred embodiment, the adjusting element as described herein, wherein the guide section comprises one or more guide grooves which are inclined in reference to a central level, at least sectionally.

In another preferred embodiment, the adjusting element as described herein, wherein the guide section comprises a first guide groove and a second guide groove, with the first guide groove and the second guide groove being oppositely inclined in reference to the central level.

The adjusting element according to claim 5, wherein the first guide groove and the second guide grove intersect.

In another preferred embodiment, the adjusting element as described herein, wherein the first guide groove shows a first cross-section and the second guide groove shows a second cross section which differs from the first cross-section.

In another preferred embodiment, the adjusting element as described herein, wherein the guide grooves comprise a first end and a second end, with the guide grooves showing an initial depth in the area of the first end and tapering towards zero in the area of the second end.

In another preferred embodiment, the adjusting element as described herein, wherein the adjusting element comprises a bearing section by which the adjusting element can be rotationally supported between the first position and the second position.

In another preferred embodiment, the adjusting element as described herein, wherein the adjusting element comprises a tubular arched section in which the guide section is arranged.

In another preferred embodiment, the adjusting element as described herein, wherein the tubular arched section covers a first angle from 70° to 110° or a second angle from 160° to 200° in reference to a central level of the adjusting element.

In another preferred embodiment, the adjusting element as described herein, wherein the adjusting element comprises an operating section, which cooperates with an actuator for operating the adjusting element between the first position and the second position.

In another preferred embodiment, the adjusting element as described herein, wherein the operating section comprises a recess or a through bore, engaged by a tappet of the actuator.

In another preferred embodiment, a device for the axial displacement of a camshaft or a camshaft section, comprising an axially displaceable camshaft or an axially displaceable camshaft section, which comprises one or more projections, and an adjusting element according to one of the previous claims.

In another preferred embodiment, the device for the axial displacement of a camshaft or a camshaft section as described herein, wherein the guide section comprises one or more guide areas of the adjusting element, arranged inclined in reference to a central level of the adjusting element, at least sectionally, and the adjusting element is arranged in reference to the camshaft or the camshaft section such that the central level extends essentially parallel to a camshaft level extending perpendicular in reference to an axis of the camshaft.

In another preferred embodiment, the device for the axial displacement of a camshaft or a camshaft section as described herein, wherein the guide section comprises one or more guide grooves which are at least sectionally inclined in reference to a central level and the adjusting element is arranged in reference to the camshaft or the camshaft section such that the central level extends essentially parallel in reference to a camshaft level, which extends perpendicular to an axis of a camshaft.

In another preferred embodiment, the device for the axial displacement of a camshaft or a camshaft section as described herein, wherein the adjusting element comprises a bearing section by which the adjusting element can be supported rotationally about an axis of rotation between a first position and a second position, with the axis of rotation extending essentially parallel in reference to the axis of the camshaft.

In another preferred embodiment, the device for the axial displacement of a camshaft or a camshaft section as described herein, wherein the device comprises an actuator which cooperates with an operating section of the adjusting element for moving the adjusting element between the first position and the second position.

In another preferred embodiment, the device for the axial displacement of a camshaft or a camshaft section as described herein, wherein the projection or projections are formed by cams of the camshaft or the camshaft section.

In another preferred embodiment, the device for the axial displacement of a camshaft or a camshaft section as described herein, wherein the projection is formed as a pin fastened in the camshaft or in the camshaft section.

In another preferred embodiment, the device for the axial displacement of a camshaft or a camshaft section as described herein, wherein the pin is supported rotationally in the camshaft or in the camshaft section.

In another preferred embodiment, a method for the axial displacement of a camshaft, supported in an axially displaceable fashion along an axis of the camshaft axis or a camshaft section, supported displaceable along the axis of the camshaft, with the camshaft or the camshaft section comprising one or more projections, comprising the following step: moving the adjusting element between a first position and a second position such that a guide section of the adjusting element cooperates with one or more of the projections of the camshaft or camshaft section in the first position such that the camshaft or the camshaft section can be axially displaced by a rotation about the axis of the camshaft and the projection does not cooperate with the guide section in the second position.

DETAILED DESCRIPTION OF THE INVENTION

Figure 1:
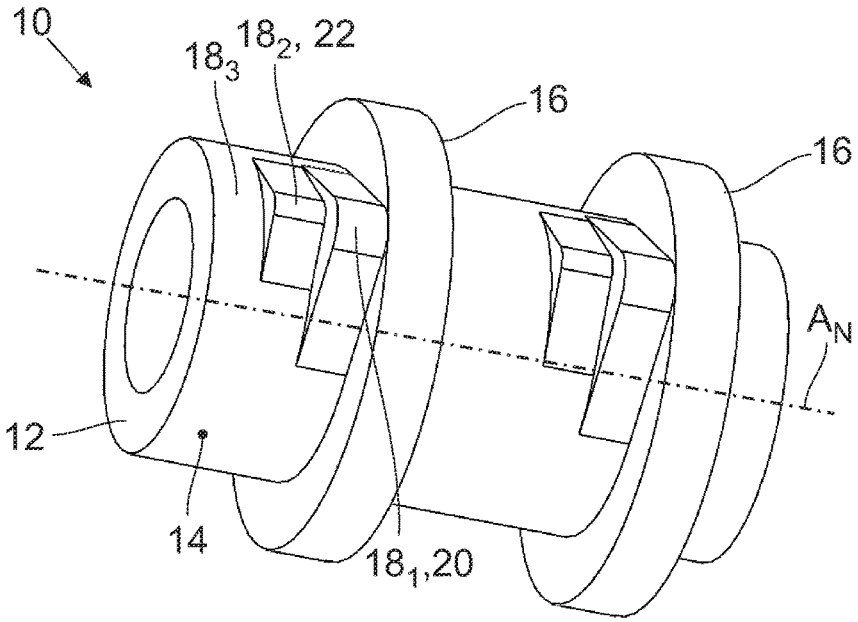
FIG. 1 is a line drawing evidencing a camshaft section according to prior art.

According to the invention the adjusting element can be moved between a first position and a second position, with the adjusting element comprising a guide section, cooperating with one or more projections of a camshaft, supported in an axially displaceable fashion, or a camshaft section, supported in an axially displaceable fashion, such that the camshaft or the camshaft section is axially displaceable by axially rotating the camshaft axis and the projection does not cooperate with the guide section in the second position. Here, it is not excluded that the adjusting element can also be brought into additional positions. It is only decisive that at least in one position the projections can cooperate with the adjusting element and in another position no cooperation is possible. An essential aspect of the present invention is given in that the guide sections are not arranged on the camshaft itself, as is the case in prior art, but on the adjusting element. The adjusting element may be designed such that even guide sections with a more complicated geometry may be produced in a relatively simple fashion. The camshaft itself no longer needs to be provided with grooves or the like, but it is sufficient to provide a projection, which cooperates with the guide section of the adjusting element when it is in the first position. This way, the production of the camshaft is considerably simplified, so that an axial displacement of the camshaft or the camshaft section can be realized in a particularly cost-effective fashion. Additionally, the camshaft is not weakened by grooves, so that overall it is more stable and the chance for the camshaft breaking is reduced.

The axial displacement of the camshaft or the camshaft section occurs as follows: the adjusting element is moved into a first position, in which the projection cooperates with the adjusting element. Subsequently the camshaft is rotated by a certain degree, for example 90°, with the projection moving along the guide section such that the form of the guide section defines the extent and the profile of motion of the axial displacement of the camshaft or the camshaft section along the axis of the camshaft. Subsequently the adjusting element is moved into the second position and the camshaft can once more be used as intended.

In a preferred embodiment the guide section comprises one or more guide areas of the adjusting element, inclined at least sectionally in reference to the central level of the adjusting element. The central level shall here extend such that it divides the adjusting element into two essentially identically sized halves. In the simplest case, the guide areas represent the exterior jacket of the adjusting element limiting the adjusting element towards the outside. The guide areas therefore form an angle with the central level. This leads to the fact that when the adjusting element is in the first position, upon rotation of the camshaft about the axis of said camshaft, a force acts upon the projection of the camshaft, aligned along the axis of the camshaft, causing the camshaft or the camshaft section to be axially displaced. In order to provide the adjusting element with this functionality a simple guide area is sufficient, with no particular features being required. In particular, it is not necessary to coordinate the projection to the guide section, which makes it possible to use the adjusting element in a flexible fashion for a plurality of axially displaceable camshafts or camshaft sections. Additionally, the production of the adjusting element is particularly simple. Furthermore, it is possible to realize even more complicated motion profiles of the camshaft during the axial adjustment, for example a relatively slow axial displacement at the onset of the rotation of the camshaft about its own axis, which accelerates over the course of the rotation.

In a preferred embodiment of the adjusting element according to the invention the guide section shows a first guide area and a second guide area, with the first guide area and the second guide area being oppositely inclined in reference to the central level. In this embodiment it is possible to axially displace the camshaft or the camshaft section both in a first direction as well as in the second opposite direction by rotating in the same direction. For this purpose, a first projection cooperates with the first guide area in a first adjustment step, causing the camshaft or the camshaft section to be axially displaced in the first direction. During the next adjustment step a second projection cooperates with the second guide area, causing the camshaft or the camshaft section to be axially displaced in the opposite direction. Here, the two projections may be arranged on the camshaft axially distanced from each other. The adjusting element is moved between the two adjustment steps into the second position.

Alternatively, it is also possible to axially displace the adjusting element between two successive adjustment steps such that the same projection cooperates with the first guide area for adjusting in one direction and with the second guide area for resetting. In this case only one projection is required.

In a preferred embodiment the guide section comprises one or more guide grooves, which are inclined in reference to a central level, at least sectionally. Contrary to the guide areas, the guide grooves show the advantage that they can transfer forces axially in reference to the axis of the camshaft along both directions. This way, a mandatory guide or a gate guide is realized. This way it is possible for the camshaft or the camshaft section, with its projection engaging a guide groove, to be axially displaced in one direction due to rotation and by a rotating in the opposite direction to axially resetting. Additionally it is possible to realize even more complicated motion profiles of the camshaft or the camshaft section during the axial adjustment, for example a relatively slow axial displacement at the outset of the rotation of the camshaft about its own axis which accelerates over the course of the rotation.

In another embodiment the guide section shows a first guide groove and a second guide groove, with the first guide groove and the second guide groove being inclined opposite in reference to the central level. As already explained regarding the guide areas, it is possible here, by rotating the camshaft in the same direction, to achieve an axial displacement of the camshaft or the camshaft section both in one as well as in the other direction. Here, two or more first and second guide grooves may be provided, essentially extending parallel to each other. This in turn makes it possible to axially move the camshaft or the camshaft section incrementally and subsequently to move it back.

Preferably the first guide groove and the second guide groove intersect. This way it can be achieved that by a rotation in the same direction the camshaft can be displaced with one projection only axially both in one direction as well as the opposite one. The two guide grooves may here be embodied such that the projection is positioned axially, after passing the first guide groove, such that it subsequently engages the second guide groove, without it being necessary to axially displace the adjusting element or to provide a second projection. This way a very compact adjusting element can be provided, which allows the displacement of the camshaft or the camshaft section in both directions with only one projection, without requiring the adjusting element to be arranged in an axially displaceable fashion. Consequently a very cost-effective and mechanically simple camshaft displacement can be realized.

In one preferred embodiment the first guide groove shows a first cross-section and the second guide groove shows a second cross-section, which differs from the first cross-section. This embodiment is particularly suitable when several first guide grooves and several second guide grooves are provided. In particular when the guide grooves show different depths, the adjusting element may be approached for example during the axial advance of the camshaft or the camshaft section somewhat further towards the camshaft so that the projection, guided by the deeper groove, is also clearly guided at intersections. When returning the camshaft or the camshaft section, the adjusting element is then advanced to a somewhat lesser extent to the camshaft so that the projection is only guided by the shallower groove, and also does not engage the deeper groove at intersections. Consequently, several first sections then develop, in which the projection can only cooperate with a certain groove. Alternatively, several projections with different sizes may be used.

Additionally it is possible to use the same adjusting element for different camshafts, which are provided with projections showing different sizes, which for example may be caused by different axial forces, which act for the adjustment of the camshaft. In this case as well it is ensured that a first projection, which further projects radially from the camshaft, actually extends only in the guide groove provided for it and does not jump erroneously into another guide groove at an intersection. Another projection, for example projecting to a lesser extent from the camshaft, but showing a greater diameter than the first projection, can therefore be hindered from engaging the wrong guide groove.

It has proven advantageous for the guide grooves to show a first end and a second end, with the guide grooves showing an initial depth in the area of the first end and tapering to zero in the area of the second end. In other words, the depth of the guide groove shall gradually reduce. In this case, the adjusting element is displaced by the projection itself from the first position in the direction of the second position when the projection passes through the guide grooves. This way, a purely mechanical resetting into the second position can be achieved. Furthermore the projection hitting the end of the groove and thus being subject to shearing forces is prevented, which might lead to a break of the projection. Furthermore, this achieves the projection no longer being guided by the guide grooves when the camshaft or the camshaft section has been displaced into the desired axial position. The projection jamming by way of canting in the groove due to the imprecisions of production or alignment errors, and consequently the adjusting element only being able to be returned into the second position with increased force or even remaining blocked, is prevented.

In a further development the adjusting element shows a bearing section by which the adjusting element can be rotationally supported between the first position and the second position. While it would also be possible to move the adjusting element to and fro with a purely translational motion between the first and the second position, the rotary support, however, is advantageous in that the bearing can be kept in a simple design and the adjustment path can be particularly short. Additionally, in this embodiment only very minor adjustment forces are required for the movement of the adjusting element.

Advantageously, the adjusting element shows a tubular, arched section, in which the guide section is arranged. The projection of the camshaft or the camshaft section, cooperating with the adjusting element, moves in a circular path. In order to allow the projection to cooperate with the guide section, the guide section must at least sectionally follow this circular path. If the adjusting element is provided with a tubular arched section, the adjusting element can be produced in a material-saving fashion and in a first position it can be guided particularly close to the camshaft. It would also be possible to use an essentially cuboid adjusting element, which shows arched guide grooves, which however considerably increases the material consumption. In order to prevent the adjusting element from colliding with the camshaft, in this case very long projections had to be used, which then however were subject to strong bending or shearing forces, which increases the risk of breakage of the projection. Additionally the projection, which may be embodied as a tappet or pin, may be supported or show a supported engagement element, with which it cooperates with an adjusting element in order to reduce the forces and momentums acting upon the projection. Such an embodiment of the projection may be provided for the adjusting element according to the invention, however in any case it is an expensive design. If the adjusting element is provided with a tubular arched section, the projections must project radially for a short distance beyond the camshaft for the above-mentioned reasons, which considerably reduces the risk of breakage due to bending or shearing forces so that no additional measures are required for reducing the stress. This keeps the production expenses low.

It is preferred for the tubular arched section to cover, in reference to a central level of the adjusting element, a first angle from approximately 70° to approximately 110° or a second angle from approximately 160° to approximately 200°. In particular when the tubular arched section covers an angle of 90° or 180°, it can be produced in a particularly simple technical fashion. Additionally it is possible to connect several adjusting elements to each other, for example two adjusting elements with a tubular arched section, which cover an angle of 90° in order to obtain an adjusting element with its tubular section covering 180° such that a modular design becomes possible. Additionally it is possible to provide distanced adjusting elements, which do not tangentially contacting each other, covering an angle of 90°. In particular when the tubular arched section covers an angle from 160° to 200° the adjusting element can be supported with a bearing section arranged on the angle bisector of the first or the second angle. In this case a toggle-like support of the adjusting element is realized. The tubular arched section is then divided by the bearing section into a first and a second sub-section. In this case the adjusting element can not only be moved between the first and the second position but also between the second and a third one. In the first position the projection may engage the first sub-section and in the third position the second sub-section. In the second position the tubular arched section extends approximately concentrically in reference to the axis of the camshaft so that the projection does not cooperate with the guide section. The adjusting element can be supported such that when one moving device which moves the adjusting element fails, it is ensured that the camshaft or the camshaft section remains in a useful position or is returned thereto. This way the internal combustion engine can remain in its operating state and the camshaft or the camshaft section can also automatically be returned into a non-critical position when the motion device malfunctions. This is particularly important in a cylinder shut-off state so that it is prevented that all cylinders can be shut off when the motion device malfunctions.

The engine is not damaged and the vehicle is still functional, although to a limited extent only, so that the driver can search for a service station without requiring external help. This increases the reliable operation.

Preferably, the adjusting element comprises an operating section which cooperates with an actuator for moving the adjusting element between the first position and the second position. In particular when the adjusting element is supported in a rotational fashion, the actuator can move between a first and a second position simply by pushing and/or pulling the operating section, utilizing the lever ratio, requiring a very low actuating power. A particular embodiment of the operating section is not required. Furthermore, the actuator can be designed in a very simple fashion.

Furthermore, it is preferred for the operating section to show a recess or a through bore, engaged by a tappet of the actuator. In this case, unlike the solutions known from prior art, only one tappet is required for displacing a camshaft, which considerably simplifies the design of the actuator. When the tappet engages the recess or the through bore during the displacement of the actuator it additionally serves for the positioning of the adjusting element and can additionally compensate forces so that the adjusting element is additionally stabilized.

The objective is furthermore attained in a device for the axial displacement of a camshaft or a camshaft section which shows an axially displaceable camshaft or an axially displaceable camshaft section, showing one or more projections, and an adjusting element according to one or the previous exemplary embodiments. The advantages and technical effects yielded with the device according to the invention are equivalent to those explained for the adjusting element according to the invention. In summary, it shall be pointed out here that it is possible with the device according to the invention to design the axial displacement of a camshaft or a camshaft section in a particularly simple fashion because the camshaft requires no difficult to manufacture guide grooves, which additionally weaken the camshaft at this point. It is sufficient, rather, to provide the camshaft or the camshaft section with a projection or a projection already provided on the camshaft or the camshaft section, namely one of the cams, for the actual displacement of the camshaft. Here, the projection may show any form and for example can also show an angular contour, comparable to a cam follower.

Preferably, the guide section comprises one or more guide areas of the adjusting element, which in reference to a central level of the adjusting element is/are at least sectionally inclined and the adjusting element is arranged in reference to the camshaft such that the central level extends essentially parallel to a camshaft level extending perpendicular to an axis of the camshaft. In this embodiment it is ensured that the guide areas in reference to a camshaft level extending perpendicular to the axis of the camshaft form a certain angle such that a force acting parallel in reference to the axis of the camshaft is applied upon the projection when the camshaft is rotated and the adjusting element is in the first position. The camshaft or the camshaft section is displaced along the axis of the camshaft via this axially acting force.

Preferably the guide section shows one or more guide grooves, which in reference to the central level is/are inclined at least sectionally, with here the adjusting element being arranged in reference to the camshaft such that the central level extends essentially parallel to a camshaft level extending perpendicular to the axis of the camshaft. This way it is also achieved that during the rotation of the camshaft an axial force is applied from the guide grooves upon the projection, causing the camshaft or the camshaft section to be axially displaced.

Preferably, the adjusting element shows a bearing section by which the adjusting element can be rotationally supported about an axis of rotation between the first position and the second position, with the axis of rotation essentially extending parallel in reference to the axis of the camshaft. Due to the fact that the axis of rotation, about which the adjusting element is supported rotationally, extends parallel to the axis of the camshaft, it is ensured that the projection can cooperate with the entire guide section when the adjusting element is located in the first position. Additionally it is achieved here that the camshaft or the camshaft section is axially displaced in the desired fashion.

Furthermore, the device may include an actuator cooperating with an operating section of the adjusting element for moving the adjusting element between a first position and the second position. With an actuator it is possible to move the adjusting element in the desired manner between the first and the second position. In particular, the actuator can be integrated in a control and regulatory circuit of an internal combustion engine such that the camshaft or the camshaft section can be axially displaced based on a certain event in one direction or the other one.

Preferably, the projection or projections are formed by cams of the camshaft or the camshaft section. In this case the camshaft or [sic] requires no special production at all in order to allow an axial displacement by the device according to the invention because the cams themselves can cooperate with the adjusting element so that an axial adjustment of the camshaft or the camshaft section is possible. An additional production expense at the camshaft or the camshaft section is not necessary. Consequently the camshaft can be produced in a particularly beneficial fashion without the ability for axial displacement being compromised.

In an alternative embodiment the projection is embodied as a pin fastened in the camshaft or the camshaft section. Contrary to the embodiment in which the cams themselves form the projection, here an additional production expense is necessary in order to fasten the pin in the camshaft or the camshaft section, however compared to the camshafts known from prior art, which are axially displaceable, this expense is considerably lower because the camshafts according to the invention do not require the presence of any complicated groove. The production expense for fastening the pins in the camshaft or the camshaft section is comparatively low. A bolt or a peg may also be used as an alternative to the pin. The peg can be formed by the basic body of the camshaft or the camshaft section so that it represents no separate component.

Here, the pin may be supported rotationally in the camshaft or the camshaft section. When the pin is moved along the guide section when the camshaft rotates, the pin glides on the guide section and friction develops between the pin and the guide section, which may lead to abrasion of the pins and the guide section. If the pin is not supported rotationally in the camshaft or the camshaft section, the friction always develops at the same area so that the abrasion flattens the pin in the respective areas, which over time may lead to the pin breaking. Furthermore, the degree of the axial displacement of the camshaft or the camshaft section is altered by the abrasion so that the desired cooperation of the cams with the valve cannot be ensured any longer.

Additionally, the abrasion may interfere with the operation of the camshaft and the device according to the invention. However, when the pin is supported rotationally, the pin is evenly worn so that no flattening develops. Furthermore, the abrasion can be reduced such that the pin does not glide along the guide section but rolls on the guide section. The rolling motion can be encouraged by roughening the contact area between the pin and the guide section.

Furthermore, the invention relates to a method for the axial displacement along an axis of a camshaft, a camshaft that is supported in an axially displaceable fashion, or a camshaft section that is supported displaceably along the axis of the camshaft, with the camshaft showing one or more projections, comprising the following step:

Moving the adjusting element between a first position and a second position such that a guide section of the adjusting element cooperates in the first position with one or more projections of the camshaft or the camshaft section so that the camshaft or the camshaft section can be axially displaced by rotating about the axis of the camshaft and in the second position the projection does not cooperate with the guide section.

Furthermore, the invention relates to the use of an adjusting element and a device according to one of the above-described exemplary embodiments for the axial displacement of a camshaft, supported displaceably along an axis of the camshaft, or a camshaft section, supported displaceably along the axis of the camshaft.

The advantages and technical effects yielded with the method according to the invention and the use according to the invention are equivalent to those explained for the adjusting element according to the invention.

DETAILED DESCRIPTION OF THE FIGURES

FIG. 1 shows a camshaft section 10 according to prior art. The camshaft section 10 shown here comprises an essentially hollow cylindrical basic body 12 with a jacket area 14, which however may also be produced as a solid cylinder, not shown. When the basic body 12 is produced as a solid cylinder, it forms the essential part of a camshaft, not shown here. Alternatively, a cylindrical shaft 15 (cf. FIG. 4) may also be provided, rotational about an axis $A_N$ of the camshaft, on which the camshaft section 10 is supported in an axially displaceable fashion along the axis $A_N$ of the camshaft. In this case the shaft 15 and the camshaft section 10 form the essential parts of a camshaft. At regular intervals the basic body 12 shows disk-shaped sections 16, which serve to reinforce the basic body and can be used for supporting the camshaft section 10.

Furthermore, three sections 18 are provided on the jacket area 14, namely a first section $\mathbf{18}_1$, on which the first cams 20 are located, a second section $\mathbf{18}_2$, on which a second cam 22 is arranged, and a third section $\mathbf{18}_3$, showing no cams at all. The first cam 20 operates a valve, not shown, of an internal combustion engine, not shown either, with a first stroke curve, while the second cam 22 operates the valve with a second stroke curve, causing the valve to open less widely and for a shorter period of time than with the first stroke curve. The third section $\mathbf{18}_3$ shows no cam at all so that any valve cooperating with the first section $\mathbf{18}_3$ is not operated when the camshaft section 10 rotates, which is the case in a shut-off cylinder, for example. The number of sections 18 is selected only as an example. In principle the number of sections 18 can be selected freely, however in practice it is limited by the structural space available.

With the different stoke curves the internal combustion engine can be operated with different characteristics, for example in a comfort-focused or a sporty mode. In order to allow operating the internal combustion engine in various modes or to completely shut off a cylinder, the camshaft section 10 must be displaced axially along the axis $A_N$ of the camshaft section such that the valve can cooperate with one of the three sections $\mathbf{18}_1$ to $\mathbf{18}_3$ on the jacket area 14 of the camshaft section 10.

Figure 2:
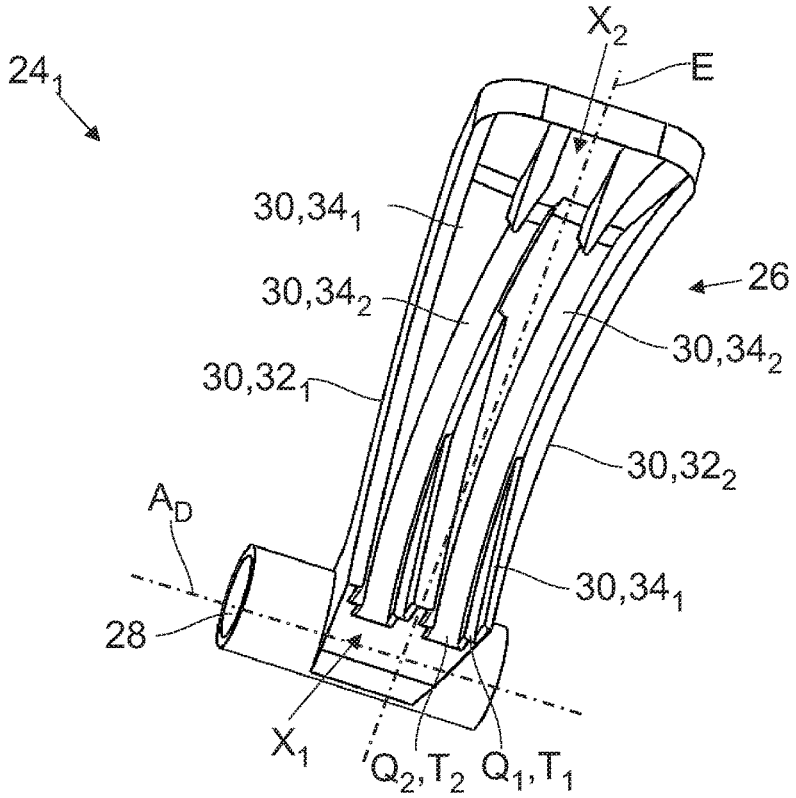
FIG. 2 is a line drawing evidencing a first exemplary embodiment of an adjusting element according to the invention.

FIG. 2 shows a first exemplary embodiment of an adjusting element $\mathbf{24}_1$ according to the invention based on a perspective illustration. The adjusting element $\mathbf{24}_1$ according to the invention shows a tubular arched section 26 and a bearing section 28. The bearing section 28 is roughly hollow and cylindrical, so that the adjusting element $\mathbf{24}_1$ can be supported in a rotational fashion about an axis of rotation $A_D$. The bearing may also be embodied such that the adjusting element $\mathbf{24}_1$ can be displaced along the axis of rotation $A_D$, which is not mandatory, though. The tubular arched section 26 is divided into two halves showing essentially the same size by a central level E, which essentially extends perpendicular in reference to the axis of rotation $A_D$. Furthermore, the adjusting element $\mathbf{24}_1$ according to the invention shows a plurality of guide sections 30, which in the example shown are formed by guide areas 32 and guide grooves 34. Concretely, the adjusting element $\mathbf{24}_1$ shows a first guide area $\mathbf{32}_1$ and a second guide area $\mathbf{32}_2$, which simultaneously represent the left and right exterior areas of the tubular arched section 26 of the adjusting element $\mathbf{24}_1$ in reference to the central level E. The first and the second guide areas $\mathbf{32}_1$, $\mathbf{32}_2$ are inclined in reference to the central level E by a certain angle, with the distance between the two guide areas $\mathbf{32}_1$, $\mathbf{32}_2$ increasing with a growing distance from the axis of rotation $A_D$. Consequently the tubular arched section 26 shows a trapezoidal shape when rolled off.

Furthermore, two first guide grooves $\mathbf{34}_1$ and two second guide grooves $\mathbf{34}_2$ are provided on the concave side of the tubular arched section 26, respectively extending parallel in reference to each other and also being inclined in reference to the central level E. However it is also possible to have the two first guide grooves $\mathbf{34}_1$ not extend parallel in reference to each other, which may also apply to the two guide grooves $\mathbf{34}_2$. In the exemplary embodiment shown the first guide area $\mathbf{32}_1$ extends parallel in reference to the first guide grooves $\mathbf{34}_1$ and the second guide area $\mathbf{32}_2$ parallel in reference to the second guide grooves $\mathbf{34}_2$, with other extensions also being possible. Additionally, it is possible to provide more than two first guide grooves $\mathbf{34}_1$ and two second guide grooves $\mathbf{34}_2$.

The first guide grooves $\mathbf{34}_1$ and the second guide grooves $\mathbf{34}_2$ are oppositely inclined in reference to each other, so that some of the guide grooves 34 intersect within the tubular arched section 26. The two first guide grooves $\mathbf{34}_1$ show a first cross-section $Q_1$ and the two second guide grooves $\mathbf{34}_2$ show a second cross-section $Q_2$, with the second cross-section $Q_2$ being wider than the first cross-section $Q_1$. In the example shown, the first and the second guide grooves $\mathbf{34}_1$, $\mathbf{34}_2$ each show an essentially rectangular cross-section. The guide grooves 34 respectively show a first end $X_1$ and a second end $X_2$, with the first guide grooves $\mathbf{34}_1$ showing a first initial depth $T_1$ in the area of the first end $X_1$ and the second guide grooves $\mathbf{34}_2$ a second initial depth $T_2$ there. The first initial depth $T_1$ is less than the second initial depth $T_2$, with the depths of the first and the second guide grooves $\mathbf{34}_1$, $\mathbf{34}_2$ reducing with an increasing distance from the bearing section 28 and tapering towards zero.

Figure 3:
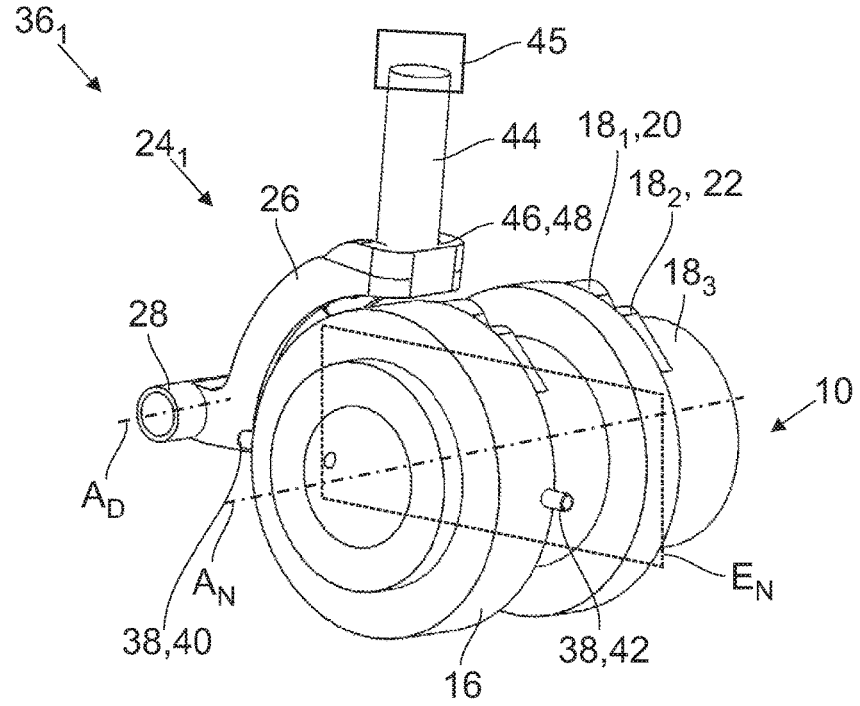
FIG. 3 is a line drawing evidencing a first exemplary embodiment of a device according to the invention with the adjusting element shown in FIG. 2.

FIG. 3 shows a first exemplary embodiment of the device $\mathbf{36}_1$ according to the invention based on a perspective illustration. The device $\mathbf{36}_1$ comprises a camshaft section 10, axially displaceable along the axis $A_N$ of the camshaft, as well as the adjusting element $\mathbf{24}_1$ shown in FIG. 2. The camshaft section 10 is essentially identical to the one shown in FIG. 1, however it shows two projections 38, which are arranged in a disk-shaped section 16. Concretely, the two projections 38 are realized as a first pin 40 and a second pin 42, which radially project by a certain degree beyond the disk-shaped section 16 and are embodied, for example as hardened pins 40, 42. The two pins 40, 42 are pressed into the camshaft section 10 and are aligned to each other. However, it is not necessary that the pins 40, 42 are aligned to each other when the guide sections 30 are embodied appropriately. It is clearly discernible from FIG. 3 that the tubular arched section 26 covers an angle of approximately 90° located in the central level E. Further, it is discernible that the axis of rotation $A_D$, about which the adjusting element $\mathbf{24}_1$ is supported rotationally, and the axis $A_N$ of the camshaft extend parallel. Additionally, a comparison of FIGS. 2 and 3 shows that the adjusting element $\mathbf{24}_1$ is arranged in reference to the camshaft section 10 such that the central level E extends parallel to an axis $A_N$ of the camshaft, which is perpendicular thereto. The adjusting element $\mathbf{24}_1$ may for example be supported at the cylinder head or the valve drive of the internal combustion engine or at the engine cover.

The adjusting element $\mathbf{24}_1$ is moved with a tappet 44 of an actuator 45, shown only in a largely simplified version, between a first position and a second position. The actuator may here comprise an electromagnet, with only one tappet 44 being sufficient to realize even more complicated adjustment sequences of the camshaft section 10. The first position shall here be defined such that at least one of the pins 40, 42 cooperates with the adjusting element $\mathbf{24}_1$, while the second position shall be defined such that none of the pins 40, 42 cooperate with the adjusting element $\mathbf{24}_1$. The first position may change during the displacement of the camshaft section 10.

In order to move the adjusting element $\mathbf{24}_1$ between the first and the second position the tappet 44 cooperates with the operating section 46, in the present example comprising a recess 48, which is engaged by the tappet 44. This way, the tappet itself accepts forces acting axially upon the adjusting element $\mathbf{24}_1$. Further positions of the adjusting element $\mathbf{24}_1$, not shown, are possible to accept forces acting axially. Alternatively, the operating section 46 may show a through bore. In principle, the tappet 44 may also engage the tubular arched section 26 at any other position.

In FIG. 3 the adjusting element $\mathbf{24}_1$ is located in the second position such that none of the two pins 40, 42 cooperates with the adjusting element $\mathbf{24}_1$. When the tappet 44 is displaced by the actuator 45 towards the axis $A_N$ of the camshaft into a first position, one of the two pins 40, 42 cooperates either with one of the guide areas 32 or one of the guide groves 34. In both cases the pins 40, 42 pass the guide areas 32 or the guide grooves 34, starting at the bearing section 28, towards the operating section 45 when the camshaft section 10 is rotated by approximately 90°. Consequently one of the pins 40, 42 glides along a guide area 32 or a guide groove 34, causing by its incline in reference to the central level E, not shown, that a force is applied along the axis $A_N$ of the camshaft upon the respective pin 40, 42 selected such that the camshaft section 10 is axially displaced along the axis $A_N$ of the camshaft. When the camshaft section 10 has been displaced into the desired axial position, the adjusting element $\mathbf{24}_1$ is moved back into the second position.

The camshaft section 10 shown in FIG. 1 comprises three sections $\mathbf{18}_1$ to $\mathbf{18}_3$. When the camshaft section 10 is in an axial position in which the first cam 20 cooperates with the valve of the internal combustion engine, the motor characteristic shall be altered so that the adjusting element $\mathbf{24}_1$ is made to approach the camshaft section 10 such that the pin 42 engages the two first guide grooves $\mathbf{34}_1$ at the right, in reference to FIG. 2. Once the pin 42 has passed through the right first guide groove $\mathbf{34}_1$ by the camshaft section 10 being rotated, the camshaft section 10 is in an axial position in which the second cam 22 cooperates with the valve. If now a cylinder shall be shut off, the adjusting element $\mathbf{24}_1$ once more is made to approach the camshaft section 10, with the incline of the guide groove 34 being selected such that the pin 42, after passing through a guide groove 34, engages the next guide groove 34. In this case, the pin 42 then engages the left of the first guide grooves $\mathbf{34}_1$ so that the camshaft section 10 is further displaced axially in the same direction so that the section $\mathbf{18}_3$ cooperates with the valve. If the camshaft section 10 shall be axially displaced back by an appropriate rotation of the camshaft section 10 either the first pin 40 is used, which compared to the second pin 42 projects slightly further beyond the jacket area 14, or the adjusting element $\mathbf{24}_1$ approaches the camshaft section 10 somewhat further and once more the second pin 42 engages. This way it is ensured that the pins 40, 42 are guided only by the deeper, second guide grooves $\mathbf{34}_2$. Another axial displacement of the camshaft section 10 can furthermore occur via the guide areas $\mathbf{32}_1$ and $\mathbf{32}_2$.

As described above, with increasing distance from the axis of rotation $A_D$ the guide grooves 34 taper towards zero. This way a reduction of the radius of the guide grooves 34 is achieved, which leads to the effect that the adjusting element $\mathbf{24}_1$ is rotated away from the camshaft section 10 when one of the pins 40, 42 passes through the guide grooves 34. The guide grooves 34 and the pins 40, 42 may here be embodied such that the adjusting element $\mathbf{24}_1$ is already located in the second position when the pins 40, 42 have completely passed through the guide grooves 34. Additionally, the weight force acting upon the adjusting element $\mathbf{24}_1$ for moving between the first and the second position can be used by an appropriate arrangement of the adjusting elements $\mathbf{24}_2$ in reference to the camshaft section 10. Alternatively the adjusting element $\mathbf{24}_1$ can be pulled by the tappet 44 into the second position or a spring mechanism may be provided which pre-stresses the adjusting element 24 into the first or second position such that the tappet 44 must apply a force only in one direction, allowing the actuator 45 to be designed in a very simple fashion. Alternatively the actuator may also comprise a bi-stable electromagnet.

Figure 4:
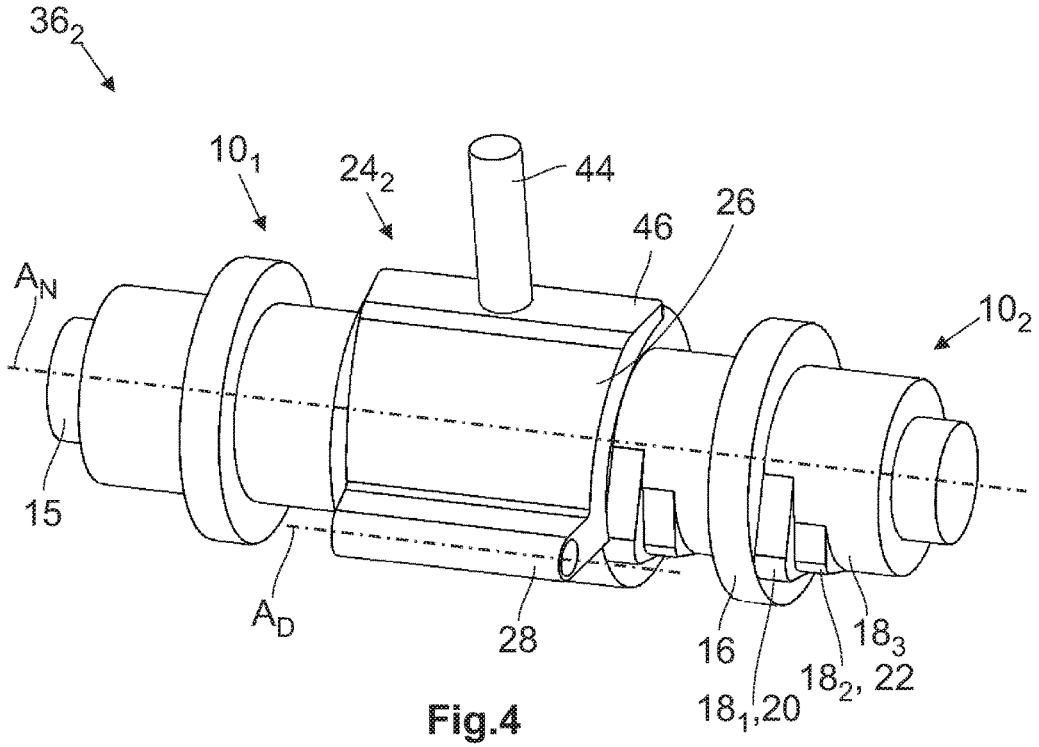
FIG. 4 is a line drawing evidencing a second exemplary embodiment of the device according to the invention with the adjusting element according to the second exemplary embodiment.

FIG. 4 shows a second exemplary embodiment of the device according to the invention $\mathbf{36}_2$ with an adjusting element $\mathbf{24}_2$ according to a second exemplary embodiment based on a perspective illustration. Here, it is easily discernible that a first and a second camshaft section $\mathbf{10}_1$, $\mathbf{10}_2$ are pushed onto the rotationally supported shaft 15, in a manner not shown, and jointly they form the essential parts of the camshaft. Once more, the axis $A_N$ of the camshaft and the axis of rotation $A_D$ extend parallel in reference to each other. Compared to the first exemplary embodiment the adjusting element $\mathbf{24}_2$ according to the second exemplary embodiment is designed slightly wider, with the tubular arched section 26 once more covering an angle of approx. 90°. Based on the width of the adjusting element $\mathbf{24}_2$ the two camshaft sections $10_1$, $10_2$ can be axially displaced by the same adjusting element $24_2$. For example it is possible to shut-off cylinders cooperating with the first camshaft section $10_1$, while the characteristic of the cylinder cooperating with the second camshaft section $10_2$ being altered. This also applies for the inlet as well as the outlet camshaft. The axial displacement of the camshaft sections $10_1$, $10_2$ along the axis $A_N$ of the camshaft occurs in the manner described above.

Figure 5:
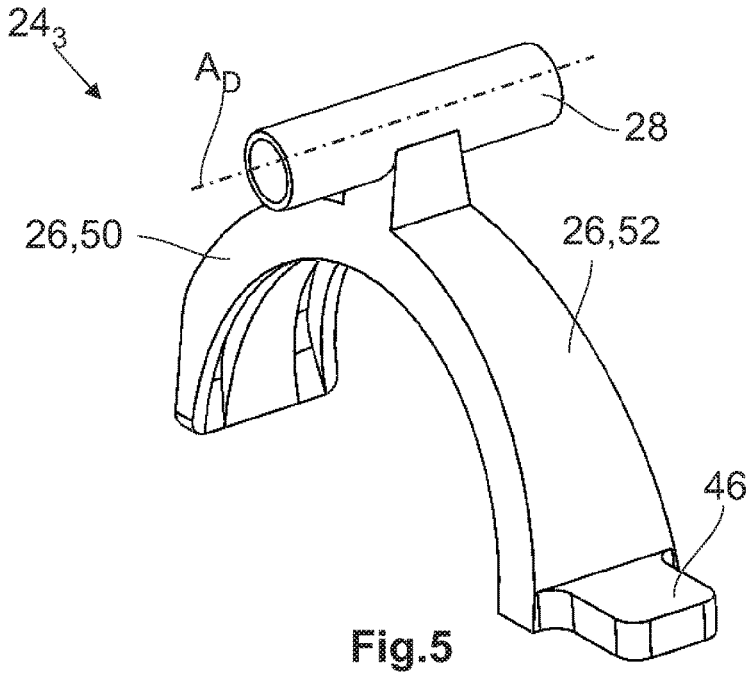
FIG. 5 is a line drawing evidencing a third exemplary embodiment of an adjusting element according to the invention.

FIG. 5 shows a third exemplary embodiment of the adjusting element $24_3$ according to the invention based on a perspective illustration. The essential difference to the other two exemplary embodiments is given here in that the tubular arched section 26 shows a first sub-section 50 and a second sub-section 52, each covering an angle of approximately 90° such that the adjusting element $24_3$ according to the third exemplary embodiment covers an angle of 180° such that the adjusting element $24_3$ shows the form of a groove or half-shell. The bearing section 28 is located approximately in the middle of the tubular arched section 26, with the two subsections 50, 52 abutting.

Figure 6:
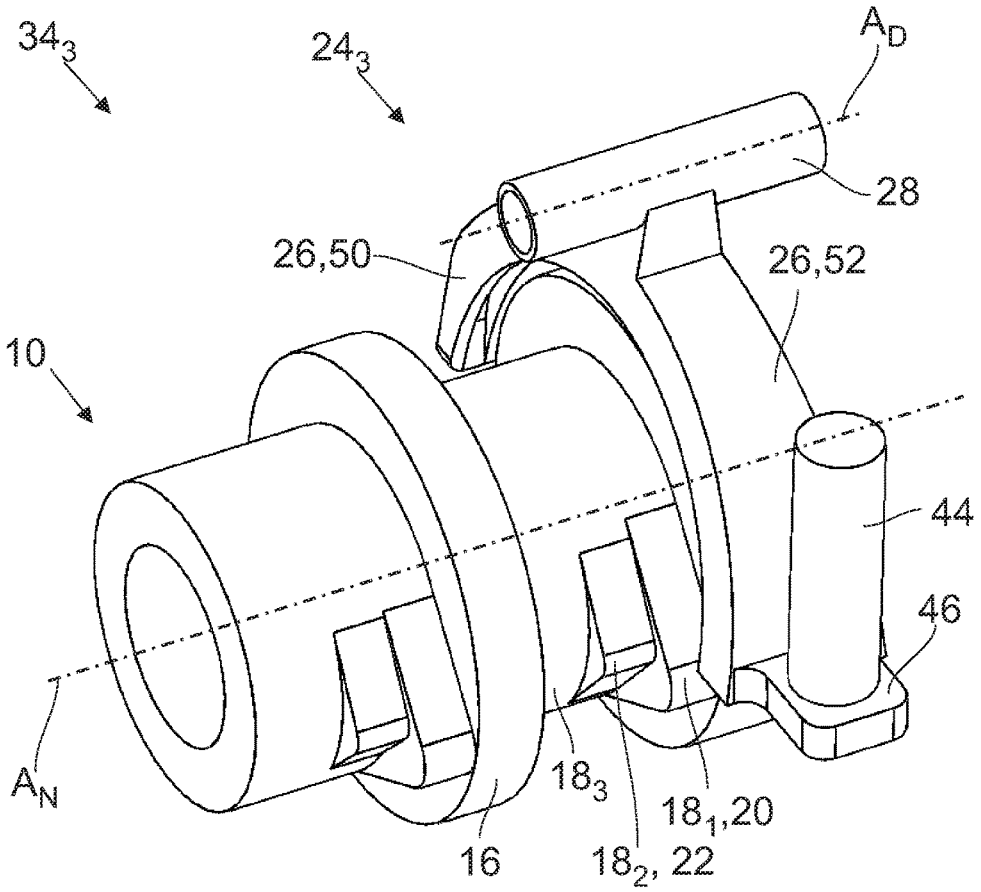
FIG. 6 is a line drawing evidencing a third exemplary embodiment of the device according to the invention with the adjusting element shown in FIG. 5.

FIG. 6 shows a third exemplary embodiment $36_3$ of the device according to the invention with the adjusting element $24_3$ shown in FIG. 5, cooperating with a camshaft section 10. The camshaft section 10 shows two pins 40, 42, not discernible in FIG. 6, and contrary to the exemplary embodiment shown in FIG. 3 they are not aligned to each other. In the third exemplary embodiment the adjusting element $24_3$ is in the second position when the first subsection 50 and the second subsection 52 show the same difference from the camshaft section 10 such that the adjusting element $24_3$ cooperates with none of the two pins 40, 42. When the actuator 45 pulls the tappet 44 towards itself, the adjusting element $24_3$ is rotated in a first direction about the axis of rotation $A_D$ and the first subsection 50 of the tubular arched section 26 cooperates with the rear pin 40 of FIG. 6. When the actuator 45 pushes the tappet 44 away from itself, the adjusting element $24_3$ is rotated in the opposite direction about the axis of rotation $A_D$ such that the frontal pin 42 engages the guide groove 34 of the second subsection 52 of the tubular arched section 26. Based on the tipping motion of the adjusting element $24_3$, the second position represents an intermediate position between the end positions of the adjusting element $24_3$. The axial displacement of the camshaft section 10 along the camshaft axis $A_N$ occurs here too in the manner described above.

The displacement is also possible in a different fashion: depending on the embodiment of the actuator 45, the zero-position of the tappet 44 can also be located in the second position of the adjusting element $24_3$ when the actuator 45 is not activated. Consequently the actuator 45 must be activated in order to rotate the adjusting element in one or the other direction about the axis of rotation $A_D$. However, it is also possible to embody the actuator 45 such that the adjusting element is adjusted into a first position when the actuator 45 is not activated in which the rear pin 40 cooperates with the first subsection 50. If no cooperation shall occur, the actuator 45 must be activated so that it displaces the tappet 44. In the event that the rear pin 40 cooperates with the first subsection 50, the adjusting element $24_3$ can be rotated such that the rear pin 40 also cooperates in the second subsection 52 with the adjusting element $24_3$. Consequently the rear pin 40 can not only pass through the first but also the second subsection 52, so that with a single pin 40 a very large axial displacement of the camshaft or the camshaft section 10 is possible.

Another option would be to perform the adjustment via an adjusting tappet. By pushing or pulling an actuator key one of the two above-mentioned quarter shells may be engaged. For example, in this embodiment a magnet can be embodied in a pushing fashion, which rotates the tappet into a cam. The tappet rotates then in the direction of the track 26 and 50 and shall not engage. The magnet is activated in a pressing fashion. The half-shell with the adjusting track is not engaged. If the adjusting tappet crosses the axis of rotation 28 it can be aligned to the respective track on the second quarter shell and adjusts the cam for example towards the left. If the actuator during the alignment to the first half-shell is not operated in the track 26 and 50 it is pressed to the right, for example. This occurs accordingly with pulling variants.

LIST OF REFERENCE NUMBERS

10, $10_1$, $10_2$ Camshaft section
12 Basic body
14 Jacket area
15 Shaft
16 Disk-shaped section
$18_1$ to $18_3$ Sections
20 First cam
22 Second cam
24, $24_1$ to $24_3$ Adjusting element
26 Tubular arched section
28 Bearing section
30 Guide section
32, $32_1$, $32_2$ Guide area
34, $34_1$, $34_2$ Guide groove
36, $36_1$ to $36_3$ Device
38 Projection
40 First pin
42 Second pin
44 Tappet
45 Actuator
46 Operating section
48 Recess
50 First subsection
52 Second subsection
$A_D$ Axis of rotation
$A_N$ Axis of the camshaft
E Central level
EN Level of the camshaft
$Q_1$ First cross-section
$Q_2$ Second cross-section
T Initial depth
$T_1$ First initial depth
$T_2$ Second initial depth
$X_1$ First end
$X_2$ Second end The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

I claim:

1. An adjusting element for the axial displacement of a camshaft supported displaceably along an axis of the camshaft or a camshaft section supported displaceably on a shaft along an axis of the camshaft, with the adjusting element being mobile between a first position and a second position, the adjusting element comprising a guide section, cooperating with one or more projections of a camshaft, supported in an axially displaceable fashion, or a camshaft section supported in an axially displaceable fashion, in a first position such that the camshaft or the camshaft section is axially displaceable by a rotation about the axis of the camshaft, the projection does not cooperate with the guide section in a second position, wherein the guide section shows one or more guide areas of the adjusting element, which are inclined at least sectionally in reference to a central level of the adjusting element, the guide section comprises a first guide area and a second guide area, with the first guide area and the second guide area being oppositely inclined in reference to the central level, wherein the distance between the first and second guide areas increases with a growing distance from the axis of rotation, and the first and the second guide area representing the left and right exterior areas of the adjustment element.

2. The adjusting element according to claim 1, wherein the guide section comprises one or more guide grooves which are inclined in reference to a central level, at least sectionally.

3. The adjusting element according to claim 2, wherein the guide section comprises a first guide groove and a second guide groove, with the first guide groove and the second guide groove being oppositely inclined in reference to the central level.

4. The adjusting element according to claim 3, wherein the first guide groove and the second guide grove intersect.

5. The adjusting element according to claim 4, wherein the first guide groove shows a first cross-section and the second guide groove shows a second cross section which differs from the first cross-section.

6. The adjusting element according to claim 2, wherein the guide grooves comprise a first end and a second end, with the guide grooves showing an initial depth in the area of the first end and tapering towards zero in the area of the second end.

7. The adjusting element according to claim 1, wherein the adjusting element comprises a bearing section by which the adjusting element can be rotationally supported between the first position and the second position.

8. The adjusting element according to claim 1, wherein the adjusting element comprises a tubular arched section in which the guide section is arranged.

9. The adjusting element according to claim 8, wherein the tubular arched section covers a first angle from 70° to 110° or a second angle from 160° to 200° in reference to a central level of the adjusting element.

10. The adjusting element according to claim 1, wherein the adjusting element comprises an operating section, which cooperates with an actuator for operating the adjusting element between the first position and the second position.

11. The adjusting element according to claim 10, wherein the operating section comprises a recess or a through bore, engaged by a tappet of the actuator.

12. A device for the axial displacement of a camshaft or a camshaft section, comprising an axially displaceable camshaft or an axially displaceable camshaft section, which comprises one or more projections, and an adjusting element according to one of the previous claims.

13. The device for the axial displacement of a camshaft or a camshaft section according to claim 12, wherein the guide section comprises one or more guide areas of the adjusting element, arranged inclined in reference to a central level of the adjusting element, at least sectionally, and the adjusting element is arranged in reference to the camshaft or the camshaft section such that the central level extends essentially parallel to a camshaft level extending perpendicular in reference to an axis of the camshaft.

14. The device for the axial displacement of a camshaft or a camshaft section according to claim 12, wherein the guide section comprises one or more guide grooves which are at least sectionally inclined in reference to a central level and the adjusting element is arranged in reference to the camshaft or the camshaft section such that the central level extends essentially parallel in reference to a camshaft level, which extends perpendicular to an axis of a camshaft.

15. The device for the axial displacement of a camshaft or a camshaft section according to claim 12, wherein the adjusting element comprises a bearing section by which the adjusting element can be supported rotationally about an axis of rotation between a first position and a second position, with the axis of rotation extending essentially parallel in reference to the axis of the camshaft.

16. The device for the axial displacement of a camshaft or a camshaft section according to claim 12, wherein the device comprises an actuator which cooperates with an operating section of the adjusting element for moving the adjusting element between the first position and the second position.

17. The device for the axial displacement of a camshaft or a camshaft section according to claim 12, wherein the projection or projections are formed by cams of the camshaft or the camshaft section.

18. The device for the axial displacement of a camshaft or a camshaft section according to claim 12, wherein the projection is formed as a pin fastened in the camshaft or in the camshaft section.

19. The device for the axial displacement of a camshaft or a camshaft section according to claim 18, wherein the pin is supported rotationally in the camshaft or in the camshaft section.

20. A method for the axial displacement of a camshaft, supported in an axially displaceable fashion along an axis of the camshaft axis or a camshaft section, supported displaceable along the axis of the camshaft, with the camshaft or the camshaft section comprising one or more projections, comprising the following step:

moving the adjusting element according to claim 1 between a first position and a second position such that a guide section of the adjusting element cooperates with one or more of the projections of the camshaft or camshaft section in the first position such that the camshaft or the camshaft section can be axially displaced by a rotation about the axis of the camshaft and the projection does not cooperate with the guide section in the second position.

* * * * *